US006732503B2

(12) United States Patent
Harima et al.

(10) Patent No.: US 6,732,503 B2
(45) Date of Patent: May 11, 2004

(54) AIR/FUEL RATIO CONTROLLER FOR INTERNAL COMBUSTION ENGINE

(75) Inventors: Kenji Harima, Toyota (JP); Koichi Hoshi, Toyota (JP); Hiromasa Suzuki, Toyota (JP); Takashi Watanabe, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/254,981

(22) Filed: Sep. 26, 2002

(65) Prior Publication Data

US 2003/0061801 A1 Apr. 3, 2003

(30) Foreign Application Priority Data

Oct. 1, 2001 (JP) ..... 2001-305708

(51) Int. Cl.[7] ..... F01N 3/00

(52) U.S. Cl. ..... 60/276; 60/274; 60/285; 60/297

(58) Field of Search ..... 60/274, 276, 285, 60/295, 297, 286, 299

(56) References Cited

U.S. PATENT DOCUMENTS 6,122,910 A * 9/2000 Hoshi et al. ..... 60/297
6,145,304 A * 11/2000 Takahashi et al. ..... 60/277
6,170,260 B1 * 1/2001 Ishii et al. ..... 60/297
6,185,933 B1 * 2/2001 Tsuzuki et al. ..... 60/285
6,401,451 B1 * 6/2002 Yasui et al. ..... 60/277
6,568,176 B2 * 5/2003 Oguma et al. ..... 60/285
6,601,383 B2 * 8/2003 Hasegawa et al. ..... 60/276

FOREIGN PATENT DOCUMENTS

JP A 7-63095 3/1995
JP A 11-82111 3/1999

* cited by examiner

*Primary Examiner*—Binh Tran
(74) *Attorney, Agent, or Firm*—Oliff & Berridge, PLC

(57) ABSTRACT

The air/fuel ratio (A/F) controller for an internal combustion engine having an upstream catalyst, a hydrocarbon-adsorbent exhaust purification (HAEP) catalyst that is disposed downstream from the upstream catalyst, an upstream A/F sensor disposed upstream from the upstream catalyst, a downstream A/F sensor disposed downstream from the HAEP catalyst, a middle A/F sensor disposed between the upstream catalyst and the HAEP catalyst, an A/F main feedback (F/B) control unit, and an A/F sub-F/B control unit. The A/F main F/B control unit performs main F/D control such that the exhaust A/F detected by the upstream A/F sensor is kept at a specific main F/B target A/F. The A/F sub-F/B control unit performs sub-F/B control such that the exhaust A/F detected by the downstream A/F sensor is kept at a specific sub-F/B target A/F during hydrocarbon desorption from the HAEP catalyst.

14 Claims, 4 Drawing Sheets

AIR/FUEL RATIO CONTROLLER FOR INTERNAL COMBUSTION ENGINE

BACKGROUND OF THE INVENTION

1. Field of the Invention

The present invention relates to an air/fuel ratio controller for an internal combustion engine which makes use of a hydrocarbon-adsorbent exhaust purification catalyst.

2. Related Background Art

Nitrogen oxides (NOx), carbon monoxide (CO), hydrocarbons (HC), and other such substances in the exhaust gas of an internal combustion engine are purified with a three-way catalyst installed along the exhaust path. Four-way catalysts, which purifies particulate matters (PM) in addition to the above-mentioned substances, are also used with diesel engines. However, these catalysts only exhibit their purification performance at a specific activation temperature. Also, since there is a tendency for a large quantity of hydrocarbons to be emitted immediately after cold start-up, a hydrocarbon adsorbent having the property of adsorbing hydrocarbons is sometimes disposed along the exhaust path.

Hydrocarbon adsorbent adsorb hydrocarbons at low temperature, and the adsorbed hydrocarbons are then desorbed once the adsorbent reaches a certain temperature. In the desorption of hydrocarbons, the catalyst reaches its activation temperature and is able to purify the desorbed hydrocarbons. This process makes it possible to reduce the hydrocarbons released into the atmosphere after cold start-up. Hydrocarbon-adsorbent exhaust purification catalysts comprising a hydrocarbon adsorbent supported on a catalyst have also been put to practical use. Internal combustion engines featuring such hydrocarbon-adsorbent exhaust purification catalysts are known from their disclosure in Japanese Laid-Open Patent Application H11-82111 and elsewhere.

A hydrocarbon-adsorbent exhaust purification catalyst combines the properties of the above-mentioned hydrocarbon adsorbent and the properties of an exhaust purification catalyst. Even a hydrocarbon-adsorbent exhaust purification catalyst, though, does not reach its activation temperature immediately after the cold start-up, so the large quantity of hydrocarbons released after the cold start-up cannot be adequately purified. Therefore, a hydrocarbon-adsorbent exhaust purification catalyst first adsorbs hydrocarbons immediately after cold start-up and desorbs the hydrocarbons as its own temperature rises. Then it uses its own exhaust purification function to oxidize and purify the desorbed hydrocarbons. When the hydrocarbons are desorbed, the hydrocarbon-adsorbent exhaust purification catalyst reaches its activation temperature.

The apparatus disclosed in the above-mentioned publication has a start-up catalyst (exhaust purification catalyst) disposed upstream along an exhaust passage so that it will be quickly heated up to its activation temperature by the hot exhaust gas, and a hydrocarbon-adsorbent exhaust purification catalyst disposed downstream from the start-up catalyst. While hydrocarbons are being desorbed from the hydrocarbon-adsorbent exhaust purification catalyst, feedback control (lean control for facilitating hydrocarbon oxidation) is performed on the basis of the output of an air/fuel ratio sensor disposed downstream from the hydrocarbon-adsorbent exhaust purification catalyst so that it will be easier to oxidize the desorbed hydrocarbons. When no hydrocarbons are being desorbed from the hydrocarbon-adsorbent exhaust purification catalyst, the system switches over to feedback control on the basis of an air/fuel ratio sensor disposed upstream from the start-up catalyst, as in normal operation.

In the apparatus disclosed in the above publication, since feedback control is performed on the basis of the air/fuel ratio sensor disposed further downstream from the downstream hydrocarbon-adsorbent exhaust purification catalyst, it takes some time for changes in the load of the internal combustion engine, external disturbances (caused by purge gas, etc.), and so forth to be reflected in the output of the air/fuel ratio sensor. Because the feedback control is based on the output of this downstream air/fuel ratio sensor, the effect of the oxygen occlusion actions of the start-up catalyst and the hydrocarbon-adsorbent exhaust purification catalyst, for example, results in it taking longer to return to the target air/fuel ratio, which tends to delay the control. As a result, exhaust purification efficiency may suffer, and there is the danger that controllability with respect to external disturbances and so on will be poor.

SUMMARY OF THE INVENTION

It is an object of the present invention to provide an air/fuel ratio controller for an internal combustion engine, with which the air/fuel ratio can be optimized even while adsorbed hydrocarbons are being desorbed from a hydrocarbon-adsorbent exhaust purification catalyst, and deterioration of exhaust purification performance can be minimized.

The air/fuel ratio controller for an internal combustion engine of the present invention comprises a upstream catalyst disposed upstream along an exhaust passage, a hydrocarbon-adsorbent exhaust purification catalyst that is disposed downstream from the upstream catalyst and has the function of adsorbing hydrocarbons at low temperatures and releasing the adsorbed hydrocarbons as the temperature rises, upstream air/fuel ratio detection means disposed upstream from the upstream catalyst, for detecting the exhaust air/fuel ratio of exhaust gas flowing into the catalyst, and downstream air/fuel ratio detection means disposed downstream from the hydrocarbon-adsorbent exhaust purification catalyst, for detecting the exhaust air/fuel ratio of exhaust gas flowing out of the hydrocarbon-adsorbent exhaust purification catalyst. The present invention also comprises air/fuel ratio main feedback control means for performing feedback control such that the exhaust air/fuel ratio detected by the upstream air/fuel ratio detection means is kept at a specific main feedback target air/fuel ratio, and air/fuel ratio sub-feedback control means for performing sub-feedback control such that the exhaust air/fuel ratio detected by the downstream air/fuel ratio detection means is kept at a specific sub-feedback target air/fuel ratio while the adsorbed hydrocarbons are being desorbed from the hydrocarbon-adsorbent exhaust purification catalyst ("during hydrocarbon desorption").

Accordingly, with the present invention, air/fuel ratio main feedback control is performed on the basis of the detection result from the upstream air/fuel ratio detection means. And, during hydrocarbon desorption, air/fuel ratio sub-feedback control is performed on the basis of the detection result from the downstream air/fuel ratio detection means on the downstream side of the hydrocarbon-adsorbent exhaust purification catalyst. "Sub-feedback control" refers to feedback control performed subordinately to main feedback control, and main feedback control takes precedence in overall control. The sub-feedback control adds fine corrections to the main feedback control so that the object of feedback control will stay at the target value. The object of main feedback control here is the exhaust air/fuel ratio of the exhaust gas flowing into the upstream catalyst, while the object of the sub-feedback control during hydrocarbon desorption is the exhaust air/fuel ratio of the exhaust gas flowing out of the hydrocarbon-adsorbent exhaust purification catalyst.

During hydrocarbon desorption, that is, in a state in which desorbed hydrocarbons and the hydrocarbons contained in the injected fuel must be oxidized (purified), sub-feedback control is performed on the basis of the exhaust air/fuel ratio of the exhaust gas flowing out of the hydrocarbon-adsorbent exhaust purification catalyst, so precise exhaust purification can be achieved. Furthermore, main feedback control based on the exhaust air/fuel ratio of the exhaust gas flowing into the upstream catalyst is also performed at this time.

And, even though the sub-feedback control may take some time to feedback, the overall control of the air/fuel ratio will be carried out precisely by main feedback control. So there will be no deterioration in exhaust purification performance due to a fluctuating air/fuel ratio or the like.

Furthermore, the present invention also comprises middle air/fuel ratio detection means disposed between the upstream catalyst and the hydrocarbon-adsorbent exhaust purification catalyst, for detecting the exhaust air/fuel ratio of exhaust gas flowing into the hydrocarbon-adsorbent exhaust purification catalyst. With the above-mentioned air/fuel ratio sub-feedback control means, after the adsorbed hydrocarbons have been desorbed from the hydrocarbon-adsorbent exhaust purification catalyst ("after hydrocarbon desorption"), sub-feedback control is performed so that the exhaust air/fuel ratio detected by the middle air/fuel ratio detection means is kept at a specific sub-feedback target air/fuel ratio. Specifically, the object of sub-feedback control after hydrocarbon desorption is the exhaust air/fuel ratio of the exhaust gas flowing into the hydrocarbon-adsorbent exhaust purification catalyst.

Consequently, after hydrocarbon desorption, sub-feedback control is performed on the basis of the exhaust air/fuel ratio of the exhaust gas flowing into the hydrocarbon-adsorbent exhaust purification catalyst as detected by the middle air/fuel ratio detection means. After hydrocarbon desorption, no hydrocarbons are desorbed from the hydrocarbon-adsorbent exhaust purification catalyst, so exhaust purification cannot be effectively performed by performing sub-feedback control on the basis of the exhaust air/fuel ratio of the exhaust gas flowing into the hydrocarbon-adsorbent exhaust purification catalyst. Furthermore, main feedback control based on the exhaust air/fuel ratio of the exhaust gas flowing into the upstream catalyst is performed as discussed above, and even though the sub-feedback control Lakes some time, the overall control of the air/fuel ratio is more precise, so there is no deterioration of the exhaust purification performance due to a fluctuating air/fuel ratio or the like.

It is preferable here to vary the sub-feedback target air/fuel ratio of the middle air/fuel ratio detection means in effect after hydrocarbon desorption with respect to the sub-feedback target air/fuel ratio of the downstream air/fuel ratio detection means in effect during hydrocarbon desorption. Since the optimal sub-feedback target air/fuel ratio depends on whether hydrocarbons are being desorbed from the hydrocarbon-adsorbent exhaust purification catalyst, varying the ratio in this way allows air/fuel ratio sub-feedback control to be performed more precisely according to each situation.

In particular, it is preferable here if the sub-feedback target air/fuel ratio of the downstream air/fuel ratio detection means in effect during hydrocarbon desorption is set to be leaner than the sub-feedback target air/fuel ratio of the middle air/fuel ratio detection means in effect after hydrocarbon desorption. During hydrocarbon desorption, the hydrocarbons desorbed from the hydrocarbon-adsorbent exhaust purification catalyst have to be oxidized (purified) in addition to the hydrocarbons contained in the exhaust gas after combustion in the engine, but setting the target for the downstream exhaust air/fuel ratio of the hydrocarbon-adsorbent exhaust purification catalyst leaner allows the hydrocarbons being desorbed from the hydrocarbon-adsorbent exhaust purification catalyst to be effectively oxidized as well, and minimizes deterioration of exhaust purification performance.

Also, the air/fuel ratio controller for an internal combustion engine of the present invention comprises a upstream catalyst, and a hydrocarbon-adsorbent exhaust purification catalyst that is disposed downstream from the upstream catalyst and has the function of adsorbing hydrocarbons at low temperatures and releasing the adsorbed hydrocarbons as the temperature rises. This is characterized in that during the desorption of hydrocarbon from the hydrocarbon-adsorbent exhaust purification catalyst, air/fuel ratio main feedback control is performed by an air/fuel ratio sensor upstream from the catalyst, and air/fuel ratio sub-feedback control, in which the target air/fuel ratio of the air/fuel ratio main feedback control is corrected, is performed such that the air/fuel ratio sensor output on the downstream of the hydrocarbon-adsorbent exhaust purification catalyst will be the target output.

With the present invention, feedback for controlling the amount of fuel injection is faster because air/fuel ratio main feedback control is performed by an air/fuel ratio sensor disposed upstream of the upstream catalyst. The exhaust purification performance is also enhanced because air/fuel ratio sub-feedback control, in which the target air/fuel ratio of the air/fuel ratio main feedback control is corrected, is performed such that the air/fuel ratio sensor output on the downstream of the hydrocarbon-adsorbent exhaust purification catalyst is kept at the target output. As a result, even if there is engine load fluctuation or external disturbance during the hydrocarbon desorption, retardation of the timing at which the fuel injection quantity is fed back with respect to air/fuel ratio fluctuation can be minimized and better exhaust purification performance obtained. The "air/fuel ratio sensor" here may be a so-called oxygen sensor whose output varies sharply depending on whether the exhaust air/fuel ratio is on lean or rich, or it maybe a so-called linear air/fuel ratio sensor that linearly monitors the exhaust air/fuel ratio from rich to lean.

After the desorption of hydrocarbons from the hydrocarbon-adsorbent exhaust purification catalyst, it is preferable here if air/fuel ratio sub-feedback control, in which the target air/fuel ratio of the air/fuel ratio main feedback control is corrected, is performed such that the air/fuel ratio sensor output on the downstream of the hydrocarbon-adsorbent exhaust purification catalyst is kept at the target output. When this is done, after hydrocarbon desorption from the hydrocarbon-adsorbent exhaust purification catalyst, no hydrocarbons are desorbed from the hydrocarbon-adsorbent exhaust purification catalyst, so exhaust purification can be effectively performed by performing air/fuel ratio sub-feedback control on the basis of the exhaust air/fuel ratio of the exhaust gas flowing into the hydrocarbon-adsorbent exhaust purification catalyst.

Furthermore, it is preferable here if the target output of the air/fuel ratio sensor during the desorption of hydrocarbons from the hydrocarbon-adsorbent exhaust purification catalyst is different from that after desorption. Doing this allows precise air/fuel ratio sub-feedback control to be performed according to whether hydrocarbons are being desorbed from the hydrocarbon-adsorbent exhaust purification catalyst. In particular, it is preferable here if the target output of the air/fuel ratio sensor during the desorption of hydrocarbons is set to be leaner than the target output after desorption. Doing this allows the hydrocarbons desorbed from the hydrocarbon-adsorbent exhaust purification catalyst to be effectively oxidized as well, and in particular allows the exhaust purification performance during hydrocarbon desorption to be improved.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
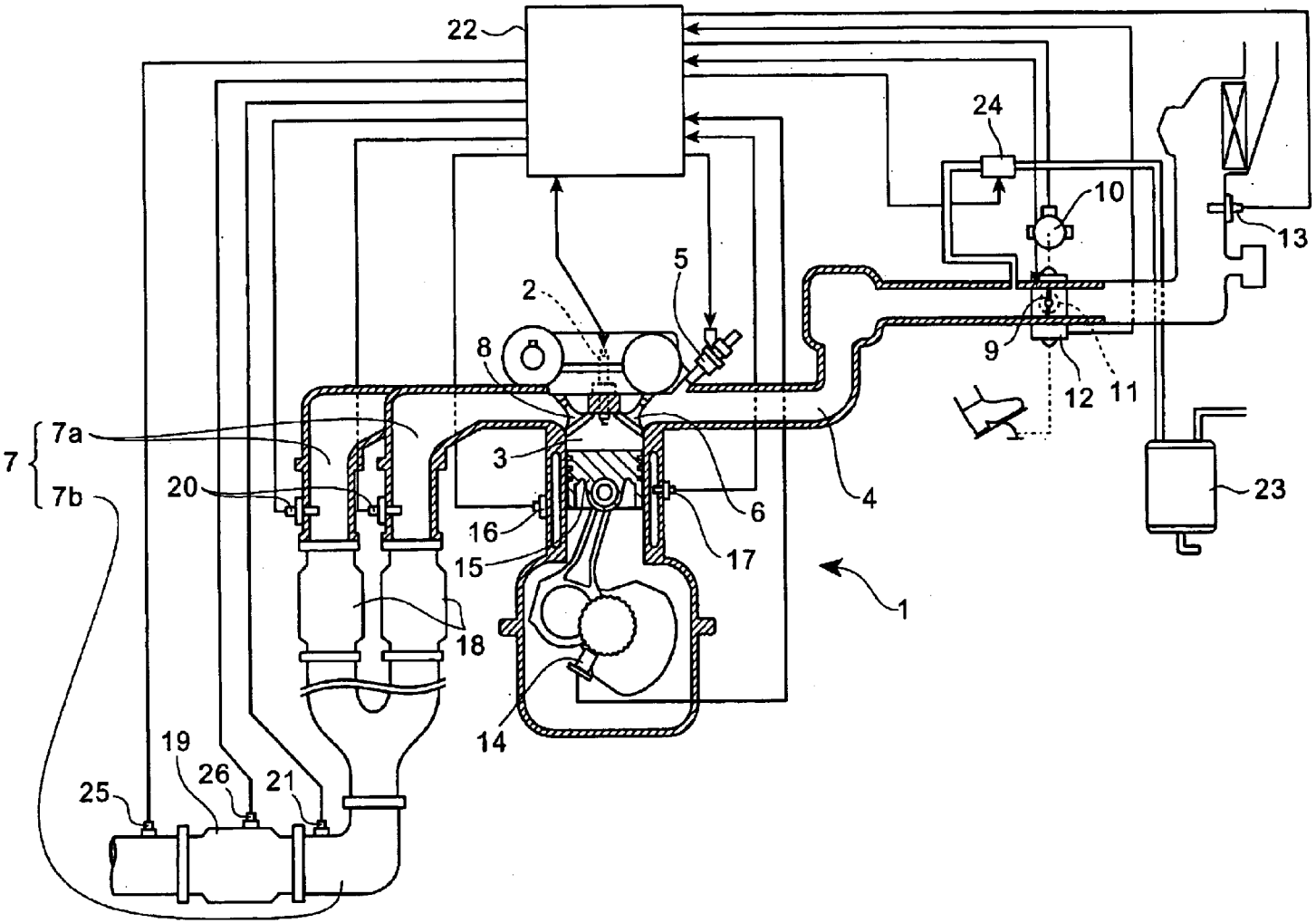
FIG. 1 is a cross section illustrating an internal combustion engine having an embodiment of the air/fuel ratio controller of the present invention.

An embodiment of the air/fuel ratio controller of the present invention will now be described through reference to the drawings. FIG. 1 is a structural diagram of an internal combustion engine having the air/fuel ratio controller in this embodiment.

The air/fuel ratio controller in this embodiment purifies the exhaust gas of an engine 1 (internal combustion engine). The engine 1 is an inline four-cylinder engine, and the cross section here depicts just one of these cylinders. The engine 1 generates its drive force when a spark plug 2 ignites a mixture within each cylinder 3. In combustion in the engine 1, air drawn in from the outside passes through an intake passage 4, is mixed with fuel injected from an injector 5, and is drawn into the cylinder 3 as a mixture.

An intake valve 6 opens and closes between the intake passage 4 and the interior of the cylinder 3. After combusting inside the cylinder 3, the mixture is discharged as exhaust gas to an exhaust passage 7. An exhaust valve 8 opens and closes between the exhaust passage 7 and the interior of the cylinder 3. A throttle valve 9 that adjusts the amount of intake air Ga drawn into the cylinder 3 is installed along the intake passage 4.

A throttle position sensor 10 is connected to the throttle valve 9. The throttle position sensor 10 senses the degree of opening of the valve 9. The opening of the throttle valve is controlled electronically, and this valve 9 is opened and closed by a throttle motor 11. An acceleration stroke sensor 12 is also installed for sensing the stroke of the accelerator pedal. An airflow meter 13 for measuring the intake air Ga is also attached along the intake passage 4.

A crank position sensor 14 that senses the rotational position of the crankshaft is attached near the crankshaft of the engine 1. The position of a piston 15 inside the cylinder 3, and the engine speed NE can also be determined from the output of the crank position sensor 14. A knock sensor 16 for detecting knocking of the engine 1, and a water temperature sensor 17 for sensing the cooling water temperature are also installed in the engine 1.

Meanwhile, the exhaust passage 7 consists of an upstream exhaust passage 7*a* and a downstream exhaust passage 7*b*. There are two upstream exhaust passages 7*a*, provided in parallel. The engine 1 in this embodiment is a four-cylinder engine, and the exhaust pipes from two cylinders combine to form one upstream exhaust passage 7*a*, while the exhaust pipes of the other two cylinders combine to form the other upstream exhaust passage 7*a*.

A start-up catalyst (upstream catalyst) 18 is disposed as an upstream exhaust purification catalyst in each of the upstream exhaust passages 7*a*. The start-up catalysts 18 are three-way catalysts, and also have an oxygen occluding function. "Oxygen occluding function" means that the catalyst occludes oxygen in the exhaust gas when the exhaust air/fuel ratio of the exhaust gas is lean, and releases the occluded oxygen when the exhaust air/fuel ratio of the exhaust gas is either stoichiometric or rich. This oxygen occluding function can be utilized to more effectively purify the components that are included in the exhaust gas and supposed to be purified. The start-up catalysts 18 are disposed close to the combustion chambers (cylinders 3) of the engine 1, so they warm up quickly, and therefore reach the catalytic activation temperature more quickly immediately after the cold start-up, which allows the substances that should be purified to be purified more quickly.

In this embodiment, an upstream air/fuel ratio sensor (upstream air/fuel ratio detection means) 20 for detecting the exhaust air/fuel ratio of the exhaust gas flowing into each of the start-up catalysts 18 is disposed upstream of each of the start-up catalysts 18. Downstream from the downstream exhaust passage 7*b*, the exhaust pipes merge into one and move to the downstream exhaust passage 7*b*. A hydrocarbon-adsorbent exhaust purification-catalyst 19 is disposed along the downstream exhaust passage 7*b*. A middle air/fuel ratio sensor (middle air/fuel ratio detection means) 21 for detecting the exhaust air/fuel ratio of the exhaust gas flowing into the hydrocarbon-adsorbent exhaust purification catalyst 19 is disposed on the upstream side of the hydrocarbon-adsorbent exhaust purification catalyst 19 (that is, in between the start-up catalysts 18 and the hydrocarbon-adsorbent exhaust purification catalyst 19).

A downstream air/fuel ratio sensor (downstream air/fuel ratio detection means) 25 for detecting the exhaust air/fuel ratio of the exhaust gas flowing out of the hydrocarbon-adsorbent exhaust purification catalyst 19 is disposed on the downstream side of the hydrocarbon-adsorbent exhaust purification catalyst 19. A catalyst temperature sensor 26 for sensing the temperature of the hydrocarbon-adsorbent exhaust purification catalyst 19 is attached thereto. The temperature of the hydrocarbon-adsorbent exhaust purification catalyst 19 can also be estimated, without using the catalyst temperature sensor 26.

The spark plug 2, injector 5, throttle position sensor 10, throttle motor 11, acceleration stroke sensor 12, airflow meter 13, crank position sensor 14, knock sensor 16, water temperature sensor 17, air/fuel ratio sensors 20, 21, and 25, catalyst temperature sensor 26, and other actuators and sensors are connected to an electronic control unit (ECU) 22 and controlled on the basis of signals from the ECU 22, or send detection results to the ECU 22. The ECU 22 is also connected, for example, to a purge control valve 24 for purging into the intake passage 4 any evaporated fuel inside the fuel tank and trapped by a charcoal canister 23.

The ECU 22 also internally has a CPU that performs calculations, a RAM that stores various information quantities such as calculation results, a backup RAM in which the stored contents are maintained by a battery, or the like. As a result, the ECU 22 functions as an air/fuel ratio main feedback control means for performing main feedback control such that the exhaust air/fuel ratio detected by the upstream air/fuel ratio sensor 20 is kept at a specific target value. The ECU 22 also functions as an air/fuel ratio sub-feedback control means for performing sub-feedback control such that the exhaust air/fuel ratio detected by the middle air/fuel ratio sensor 21 or the downstream air/fuel ratio sensor 25 is kept at a specific target value. The ECU 22 is also a main feedback control unit or a sub-feedback control unit.

The main feedback control and sub-feedback control have already been discussed, and in air/fuel ratio control, the air/fuel ratio main feedback control takes precedence over the air/fuel ratio sub-feedback control. The air/fuel ratio sub-feedback control involves adding supplemental correction to the air/fuel ratio main feedback control. The ECU 22 also serves as an air/fuel ratio control means for controlling the amount of fuel injected from the injector 5.

Let us now briefly describe the relation between air/fuel ratio main feedback control and air/fuel ratio sub-feedback control. The air/fuel ratio main feedback control is the feedback control of the amount of fuel injection (air/fuel ratio) on the basis of the detection results from the upstream air/fuel ratio sensors 20 disposed upstream from the start-up catalysts 18. The air/fuel ratio main feedback control results in the variance in the current air/fuel ratio with respect to the targeted control air/fuel ratio being sequentially fed back (PI control) and adjusted to the targeted air/fuel ratio.

In contrasts the air/fuel ratio sub-feedback control involves correcting the target air/fuel ratio of the above-mentioned air/fuel ratio main feedback control in order to adjust the exhaust air/fuel ratio (oxygen concentration) detected by the downstream air/fuel ratio sensor 25 disposed downstream from the hydrocarbon-adsorbent exhaust purification catalyst 19 (during hydrocarbon desorption), or by the middle air/fuel ratio sensor 21 disposed between the start-up catalysts 18 and the hydrocarbon-adsorbent exhaust purification catalyst 19 (after hydrocarbon desorption) to the target air/fuel ratio. The air/fuel ratio sub-feedback control makes suitable corrections according to the difference between the targeted air/fuel ratio sensor output and the current air/fuel ratio sensor output.

The main feedback amount edfi in air/fuel ratio main feedback control is calculated from the following Equation (i).

$$edfi = EGMFBP \times ekmfbp \times edfckm + EGMFBI \times ekmfbi \times esdfc \quad \text{(i)}$$

EGMFBP: main feedback proportional gain ekmfbp: main feedback proportional load coefficient edfckm: deviation between actual amount of fuel in cylinder and target amount of fuel (variable)

EGMFBI: main feedback integral gain ekmfbi: main feedback integral load coefficient esdfc: sum of deviations between actual amount of fuel in cylinder and target amount of fuel (variable)

Since the air/fuel ratio main feedback control is PI control (proportional-integral control), Equation (i) includes terms for proportional control (P control) and integral control (I control). The main feedback amount edfi is the amount of injected fuel reflected in the basic fuel injection amount as the result of main feedback control (increases the basic fuel injection amount). edfi may be directly calculated as the amount of injected fuel, or it maybe calculated as a value replaced by the amount of injected fuel, the open time of the fuel injection valve, etc.

Of the terms in Equation (i) above, edfckm is obtained from the following Equation (ii).

$$edcfkm = emc/eabyf - efcr \quad \text{(ii)}$$

emc: amount of intake air (detected by the airflow meter 13 eabyf: intake air/fuel ratio (obtained by correcting the detection result from the upstream air/fuel ratio sensor 20)

efcr: target amount of fuel in the cylinder

Specifically, the term emc/eabyf corresponds to the actual amount of fuel in the cylinder.

Meanwhile, esdfc is obtained from the following Equation (iii).

$$esdfc = \Sigma edcfkm \quad \text{(iii)}$$

Specifically, esdfc is the sum of edcfkm as mentioned above.

This is how the main feedback amount of the air/fuel ratio main feedback control is calculated. In air/fuel ratio sub-feedback control, a correction is added to the main feedback control by correcting eabyf through reflection of the sub-feedback amount versus the above-mentioned eabyf.

Next, we will describe the calculation of the sub-feedback amount of air/fuel ratio sub-feedback control. The air/fuel ratio sub-feedback control is also PI control. The sub-feedback amount cvafsfb is calculated from the following Equation (iv). In the air/fuel ratio sub-feedback control described herein, the calculation is conducted based on the voltage value of the air/fuel ratio sensor.

$$evafsfb = EGSFBP \times edvos + EGSFBI \times esdvos \quad \text{(iv)}$$

EGSFBP: sub-feedback proportional gain edvos: difference between target voltage and output voltage of air/fuel ratio sensor used in sub-feedback control EGSFBI: sub-feedback integral gain esdvos: sum of differences between target voltages and output voltages of air/fuel ratio sensor used in sub-feedback control This sub-feedback amount evafstb is reflected versus the above-mentioned main feedback amount edfi, and as already mentioned, this is reflected through eabyf. If we let evabyf be the value of eabyf corresponding to the output voltage of the air/fuel ratio sensor, then evabyf is found from the following Equation (v).

$$evabyf=evafbse+evafsfbg+evafstg+evafsfb \quad (v)$$

evafbse: intake air/fuel ratio (output voltage of the upstream air/fuel ratio sensor 20)

evafsfbg: sub-feedback control learned value (voltage equivalent)

evafstg: air/fuel ratio sensor stoichiometric learned value (voltage equivalent)

evafbse is the unchanged output voltage of the upstream air/fuel ratio sensor 20. evafsfbg is the learned value found from the history of sub-feedback control, and is used to increase the accuracy of sub-feedback control. evafstg is correcting the variance of the reference output (stoichiometric output) of the upstream air/fuel ratio sensor 20 on the basis of learning the cold output (stoichiometric equivalent output: it is the output when the sensor 20 is not heated) of the sensor 20. The above-mentioned sub-feedback control amount is added here (if the sub-feedback control amount is a negative value, the amount is actually subtracted).

As a result, the output of the upstream air/fuel ratio sensor 20 is set so that it is apparently on either richer or leaner. Main feedback control is performed on the basis of this so that the air/fuel ratio output (output voltage) detected by the upstream air/fuel ratio sensor 20 is kept at a specific main feedback target air/fuel ratio (target voltage), the result being that the sit-feedback control amount is reflected in the control. Specifically, if we consider a case in which no air/fuel ratio sub-feedback control is performed, evabyf is obtained as evafbse+evafsfbg+evafstg, and the sensor output is merely corrected to improve accuracy. However, if this sensor output value is apparently shifted by using the sub-feedback control amount, the correction to the air/fuel ratio sub-feedback control will be reflected in the air/fuel ratio main feedback control.

Next, we will describe the control in this embodiment through reference to a flow chart. As discussed above, basically the air/fuel ratio main feedback control is performed on the basis of the upstream air/fuel ratio sensor 20 (it may not be performed when the internal combustion engine is in a state that does not allow air/fuel ratio main feedback control to be performed).

Figure 2:
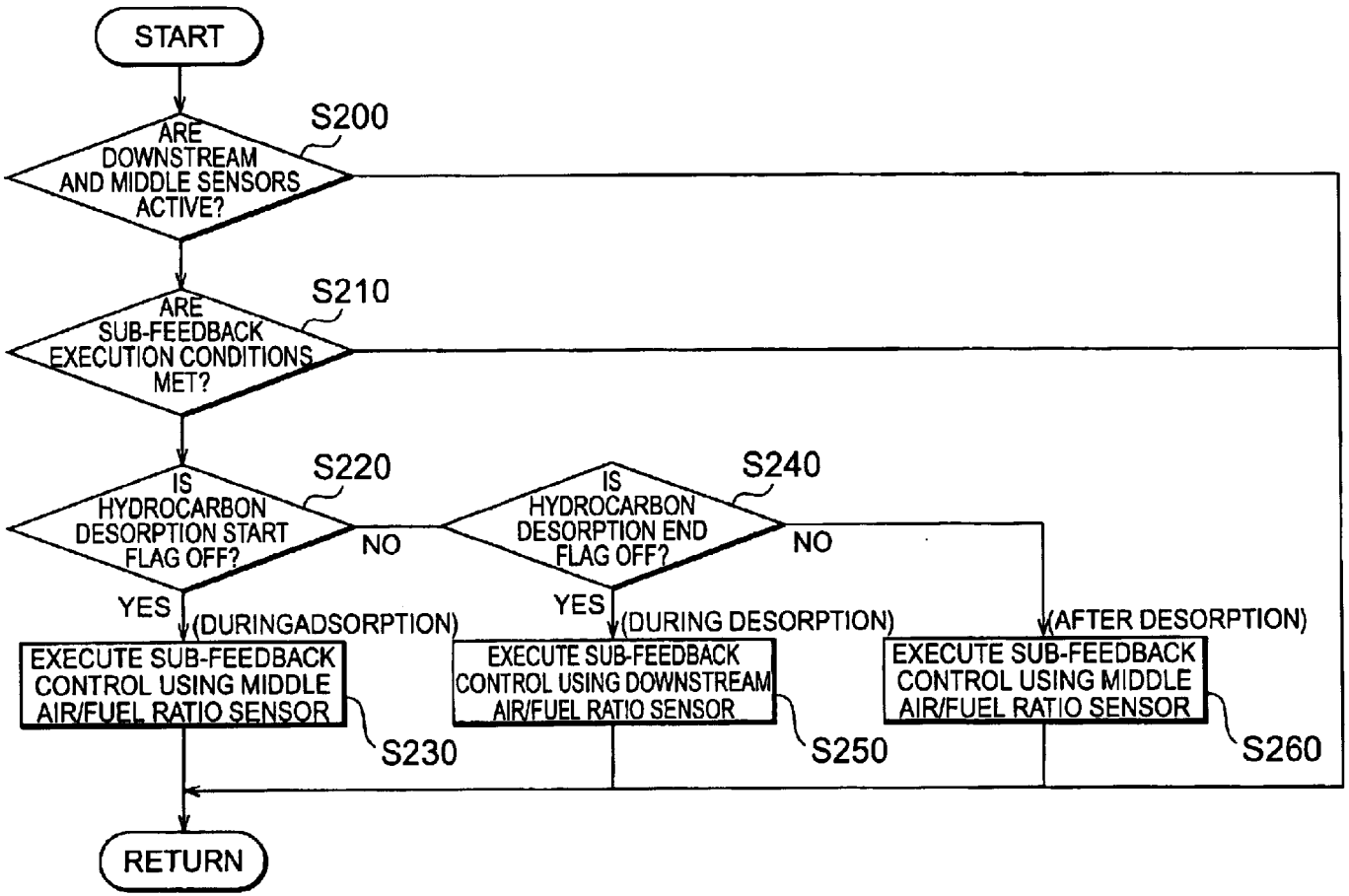
FIG. 2 is a flow chart for determining which air/fuel ratio sensor (the middle air/fuel ratio sensor or the downstream air/fuel ratio sensor) to use in the air/fuel ratio sub-feedback control.

FIG. 2 is a flow chart of deciding which air/fuel ratio sensor (the middle air/fuel ratio sensor 21 or the downstream air/fuel ratio sensor 25) the air/fuel ratio sub-feedback control will be based on. As discussed above, in this embodiment, air/fuel ratio sub-feedback control is performed on the basis of the output of the downstream air/fuel ratio sensor 25 from the point when the hydrocarbons adsorbed in the hydrocarbon-adsorbent exhaust purification catalyst 19 begin to be desorbed along with its temperature raise until the desorption of the adsorbed hydrocarbons is complete. In contrast, after the desorption of the adsorbed hydrocarbons is complete (and during adsorption of hydrocarbons), the air/fuel ratio sub-feedback control is performed on the basis of the output from the middle air/fuel ratio sensor 21.

The control in the flow chart shown in FIG. 2 relates to selecting the air/fuel ratio sensor to be used in the air/fuel ratio sub-feedback control, and is repeatedly executed at specific Lime intervals. First, a decision is made as to whether the middle air/fuel ratio sensor 21 and the downstream air/fuel ratio sensor 25 have both reached the activation temperature and become activated (step 200). If the air/fuel ratio sensors 21 and 25 are not activated, the exhaust air/fuel ratio cannot be accurately detected, so in the event that step 200 is negative, the flow chart shown in FIG. 2 is temporarily exited, and sub-feedback control is not performed. Here, if the condition is one that allows the air/fuel ratio main feedback control to be performed, then just the air/fuel ratio main feedback control is carried out. If the condition is one that does not allow the air/fuel ratio main feedback control to be performed (such as when the upstream air/fuel ratio sensor 20 has not been activated), then even the air/fuel ratio main feedback control is not carried out.

When step 200 is positive, a decision is then made as to whether the execution conditions are right for performing air/fuel ratio sub-feedback control (step 210). These execution conditions may include whether the fuel injection amount has been increased while cold, or whether air/fuel ratio main feedback control is being executed. If step 210 is negative, the flow chart shown in FIG. 2 is temporarily exited. The air/fuel ratio sub-feedback control is not performed in this case. Here again, if the condition is one that allows the air/fuel ratio main feedback control to be performed, then just the air/fuel ratio main feedback control is carried out, as mentioned above.

Meanwhile, if step 210 is positive, then a decision is made as to whether the-hydrocarbon desorption start flag is off (step 220). The hydrocarbon desorption start flag and the hydrocarbon desorption end flag will now be described through reference to FIG. 3. As mentioned above, the hydrocarbon-adsorbent exhaust purification catalyst 19 adsorbs hydrocarbons when its temperature is low, and desorbs the adsorbed hydrocarbons as its temperature rises. The hydrocarbon-adsorbent exhaust purification catalyst 19 in this embodiment adsorbs hydrocarbons when its temperature is up to 80 centigrade degrees, and begins to desorb the hydrocarbons from 80 centigrade degrees.

Figure 3:
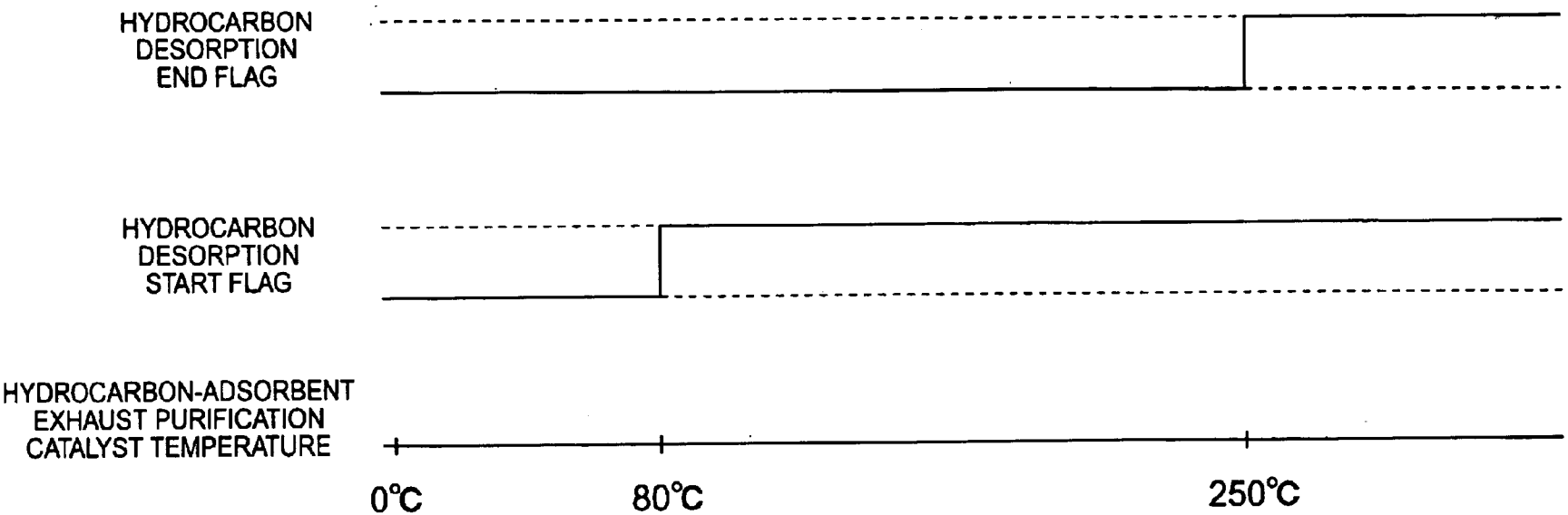
FIG. 3 is a timing chart illustrating the status of the hydrocarbon desorption start flag and the hydrocarbon desorption end flag.

Accordingly, as shown in FIG. 3, the hydrocarbon desorption start flag is off when the temperature of the hydrocarbon-adsorbent exhaust purification catalyst 19 is less than 80 centigrade degrees, and is on at 80 centigrade degrees or higher. Specifically, when the hydrocarbon desorption start flag is off, it can be concluded that the desorption of hydrocarbons from the hydrocarbon-adsorbent exhaust purification catalyst 19 has not yet begun. On the other hand, when the hydrocarbon desorption start flag is on, it can be concluded that the desorption of hydrocarbons from the hydrocarbon-adsorbent exhaust purification catalyst 19 has begun and desorption is in progress, or that the desorption of hydrocarbons has already ended.

A hydrocarbon desorption end flag is also used along with the hydrocarbon desorption start flag. With the hydrocarbon-adsorbent exhaust purification catalyst 19 in this embodiment, once the temperature of the hydrocarbon-adsorbent exhaust purification catalyst 19 reaches 250 degrees or higher, it can be concluded that all of the adsorbed hydrocarbons have been desorbed. Accordingly, as shown in FIG. 3, the hydrocarbon desorption end flag is off when the temperature of the hydrocarbon-adsorbent exhaust purification catalyst 19 is under 250 degrees, and is on at 250 degrees or higher. Specifically, when the hydrocarbon desorption end flag is off, it can be concluded that either the desorption of hydrocarbons from the hydrocarbon-adsorbent exhaust purification catalyst 19 has yet to begin, or desorption is in progress. On the other hand, when the hydrocarbon desorption end flag is on, it can be concluded that the desorption of hydrocarbons from the hydrocarbon-adsorbent exhaust purification catalyst 19 has already ended.

Specifically, the status of the hydrocarbon-adsorbent exhaust purification catalyst 19 can be ascertained by simultaneously referring to both the hydrocarbon desorption start flag and the hydrocarbon desorption end flag. If the hydrocarbon desorption start flag is off and the hydrocarbon desorption end flag is off (if the hydrocarbon desorption start flag is off, the hydrocarbon desorption end flag will always be off), then the hydrocarbon-adsorbent exhaust purification catalyst is in the midst of adsorbing hydrocarbons. If the hydrocarbon desorption start flag is on and the hydrocarbon desorption end flag is off, then the hydrocarbon-adsorbent exhaust purification catalyst is in a state of desorbing hydrocarbons. If the hydrocarbon desorption start flag is on and the hydrocarbon desorption end flag is on, then the hydrocarbon-adsorbent exhaust purification catalyst is in a state in which the hydrocarbons have already been desorbed.

If the above-mentioned step 220 is positive, then the hydrocarbon-adsorbent exhaust purification catalyst is in the midst of adsorbing hydrocarbons, so air/fuel ratio sub-feedback control is executed on the basis of the output of the middle air/fuel ratio sensor 21, that is, on the basis of the exhaust air/fuel ratio of the exhaust gas flowing into the hydrocarbon-adsorbent exhaust purification catalyst 19 (step 230). On the other hand, if the above-mentioned step 220 is negative, then a decision is made as to whether the hydrocarbon desorption end flag is off (step 240). If step 240 is positive, then the hydrocarbon-adsorbent exhaust purification catalyst is in the process of desorbing hydrocarbons, so air/fuel ratio sub-feedback control is executed on the basis of the output from the downstream air/fuel ratio sensor 25, that is, on the basis of the exhaust air/fuel ratio of the exhaust gas flowing out of the hydrocarbon-adsorbent exhaust purification catalyst 19 (step 250).

If step 240 is negative, then all of the hydrocarbons have already been desorbed from the hydrocarbon-adsorbent exhaust purification catalyst, so air/fuel ratio sub-feedback control is executed on the basis of the output from the middle air/fuel ratio sensor 21, that is, on the basis of the exhaust air/fuel ratio of the exhaust gas flowing into the hydrocarbon-adsorbent exhaust purification catalyst 19 (step 260). In air/fuel ratio sub-feedback control, just as in the above-mentioned air/fuel ratio main feedback control, the matching of the output voltage of the middle air/fuel ratio sensor 21 (or the downstream air/fuel ratio sensor 25) with the exhaust air/fuel ratio has already been corroborated by experimentation or the like, and control is performed such that the output voltage from the middle air/fuel ratio sensor 21 (or the downstream air/fuel ratio sensor 25) will be kept at a specific target voltage.

Thus, control delays and air/fuel ratio fluctuations can be prevented, and the air/fuel ratio can be controlled more precisely, by performing air/fuel ratio sub-feedback control on the basis of the downstream air/fuel ratio sensor 25 only while hydrocarbons are being desorbed from the hydrocarbon-adsorbent exhaust purification catalyst 19. Also, as discussed above, exhaust purification can be carried out more precisely if the sub-feedback target air/fuel ratio during air/fuel ratio sub-feedback control based on the middle air/fuel ratio sensor 21, and the sub-feedback target air/fuel ratio during air/fuel ratio sub-feedback control based on the downstream air/fuel ratio sensor 25 are set to match the various situations (varying one sub-feedback target air/fuel ratio with respect to the other).

Figure 4:
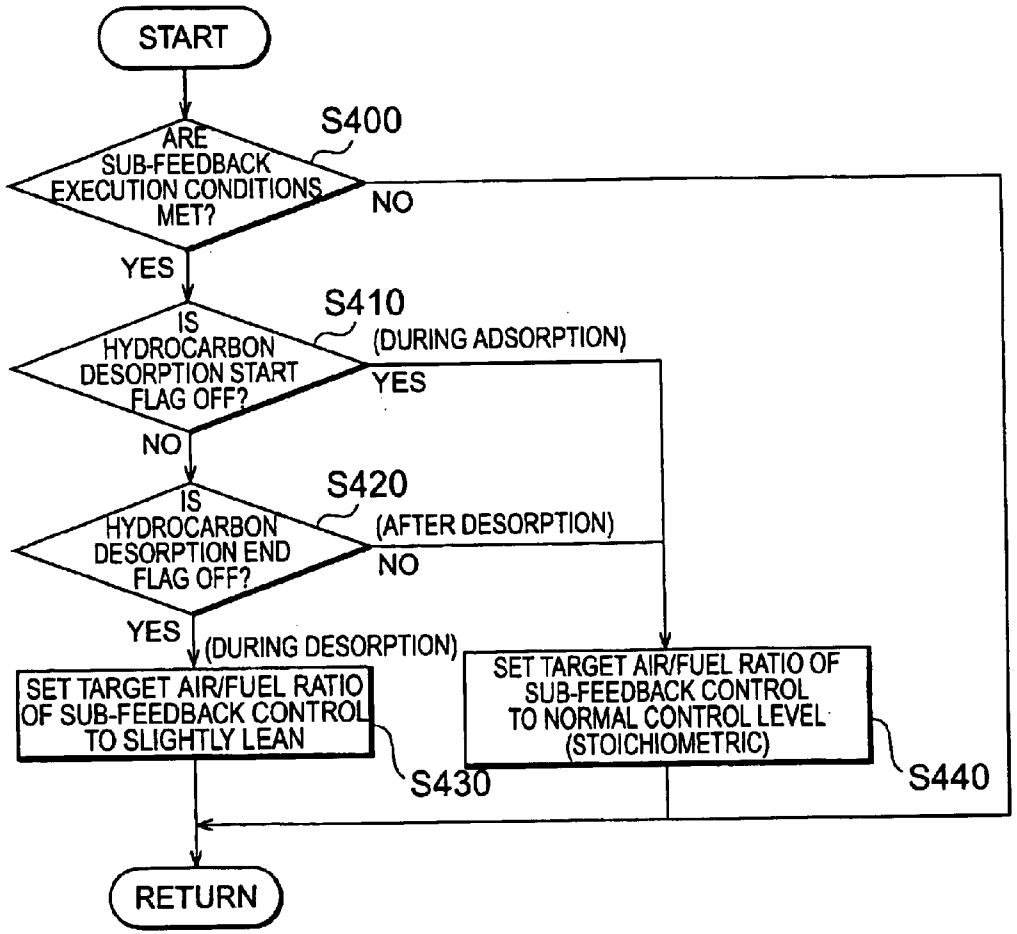
FIG. 4 is a flowchart for determining the sub-feedback target air/fuel ratio in air/fuel ratio sub-feedback control.

In particular, an improvement in exhaust purification performance is achieved in this embodiment by setting the sub-feedback target air/fuel ratio during air/fuel ratio sub-feedback control based on the downstream air/fuel ratio sensor 25 to be leaner than the sub-feedback target air/fuel ratio during air/fuel ratio sub-feedback control based on the middle air/fuel ratio sensor 21 while hydrocarbons are being desorbed from the hydrocarbon-adsorbent exhaust purification catalyst 19. FIG. 4 is a flow chart of the control relating to the setting of the sub-feedback target air/fuel ratio (the target output voltage of the air/fuel ratio sensor), and this process is repeatedly executed at specific time intervals. The switching control of the sub-feedback target air/fuel ratio will be described through reference to FIG. 4.

First, a decision is made as to whether the execution conditions are right for air/fuel ratio sub-feedback control (step 400). This step is the same as step 210 in the flow chart shown in FIG. 2. If step 400 is negative, then the situation is one in which air/fuel ratio sub-feedback control is not performed, so the sub-feedback target air/fuel ratio is not set, and the flowchart in FIG. 4 is temporarily exited. On the other hand, it step 400 is positive, then a decision is made as to whether the hydrocarbon desorption start flag is off (step 410). This step is the same as step 220 in the flow chart shown in FIG. 2.

If step 410 is positive, the hydrocarbon-adsorbent exhaust purification catalyst is in the midst of adsorbing hydrocarbons, so the sub-feedback target air/fuel ratio (stoichiometric) is set for air/fuel ratio sub-feedback control based on the output of the middle air/fuel ratio sensor 21, that is, based on the exhaust air/fuel ratio of the exhaust gas flowing into the hydrocarbon-adsorbent exhaust purification catalyst 19 (step 440). On the other hand, if the above-mentioned step 410 is negative, then a decision is made as to whether the hydrocarbon desorption end flag is off (step 420).

If step 420 is positive, the hydrocarbon-adsorbent exhaust purification catalyst is in the midst of desorbing hydrocarbons, so the sub-feedback target air/fuel ratio is set (on the lean side) for air/fuel ratio sub-feedback control on the basis of the output of the downstream air/fuel ratio sensor 25, that is, on the basis of the exhaust air/fuel ratio of the exhaust gas flowing out of the hydrocarbon-adsorbent exhaust purification catalyst 19 (step 430). If step 420 is negative, all of the hydrocarbons have already been desorbed from the hydrocarbon-adsorbent exhaust purification catalyst, so the sub-feedback target air/fuel ratio is set (stoichiometric) for air/fuel ratio sub-feedback control on the basis of the output of the middle air/fuel ratio sensor 21, that is, on the basis of the exhaust air/fuel ratio of the exhaust gas flowing into the hydrocarbon-adsorbent exhaust purification catalyst 19 (step 440).

As a result, while hydrocarbons are being desorbed from the hydrocarbon-adsorbent exhaust purification catalyst 19, the hydrocarbons desorbed from the hydrocarbon-adsorbent exhaust purification catalyst 19 also have to be oxidized (purified) in addition to the hydrocarbons contained in the exhaust gas, but setting the target for the downstream exhaust air/fuel ratio of the hydrocarbon-adsorbent exhaust purification catalyst 19 leaner allows the hydrocarbons being desorbed from the hydrocarbon-adsorbent exhaust purification catalyst 19 to be effectively oxidized a swell, and minimizes deterioration of exhaust purification performance.

In a state in which hydrocarbons are being desorbed from the hydrocarbon-adsorbent exhaust purification catalyst 19, the oxygen occluding function of the hydrocarbon-adsorbent exhaust purification catalyst 19 will not be fully manifested, so very little oxygen is consumed (occluded) inside the hydrocarbon-adsorbent exhaust purification catalyst 19. If in this case air/fuel ratio sub-feedback control is performed on the basis of the output of the downstream air/fuel ratio sensor 25, the air/fuel ratio can be controlled according to the desorbed hydrocarbons, the oxygen required to purify the desorbed hydrocarbons can be supplied to the interior of the hydrocarbon-adsorbent exhaust purification catalyst 19, and an increase in NOx emissions can be suppressed while hydrocarbon emissions are reduced.

The air/fuel ratio controller of the present invention is not limited to that in the embodiment given above. For example, in the above embodiment the start-up catalysts 18 were ordinary three-way catalysts, but may instead be NOx occluding and reducing catalysts. Also, the air/fuel ratio sensors 20, 21, and 25 may be so-called $O_2$ sensors, whose output varies between off and on depending on whether the exhaust gas air/fuel ratio is rich or lean, or maybe so-called linear air/fuel ratio sensors, which linearly monitor the exhaust air/fuel ratio from the rich side to the lean side. Naturally, any combination of these may also be used.

Further, in the above embodiment a single upstream exhaust passage 7*a* was formed from two exhaust pipes of a four-cylinder engine 1, but the present invention is not limited to this configuration. For instance, in the case of a V-type engine, it is natural to install one upstream exhaust passage (upstream exhaust purification catalyst) on each bank.

As discussed above, the air/fuel ratio controller for an internal combustion engine of the present invention comprises a upstream catalyst, a hydrocarbon-adsorbent exhaust purification catalyst, upstream air/fuel ratio detection means, downstream air/fuel ratio detection means, air/fuel ratio main feedback control means for performing main feedback control such that the exhaust air/fuel ratio detected by the upstream air/fuel ratio detection means is kept at a specific target value, and air/fuel ratio sub-feedback control means for performing sub-feedback control such that the exhaust air/fuel ratio detected by the downstream air/fuel ratio detection means is kept at a specific sub-feedback target air/fuel ratio while adsorbed hydrocarbons are being desorbed from the hydrocarbon-adsorbent exhaust purification catalyst.

While adsorbed hydrocarbons are being desorbed from the hydrocarbon-adsorbent exhaust purification catalyst, air/fuel ratio sub-feed back control is performed on the basis of the detection results from the downstream air/fuel ratio detection means. While hydrocarbons are being desorbed from the hydrocarbon-adsorbent exhaust purification catalyst, the hydrocarbons desorbed from the hydrocarbon-adsorbent exhaust purification catalyst also have to be oxidized (purified) in addition to the hydrocarbons contained in the injected fuel. With the present invention, in a situation such as this, precise exhaust purification can be performed because sub-feedback control is performed on the basis of the final exhaust air/fuel ratio of the exhaust gas flowing out of the hydrocarbon-adsorbent exhaust purification catalyst. Here, main feedback control is performed on the basis of the exhaust air/fuel ratio of the exhaust gas flowing into the catalysts, and even though the sub-feedback control takes some time, the overall control of the air/fuel ratio is more precise, so there is no deterioration of the exhaust purification performance due to a fluctuating air/fuel ratio or the like.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An air/fuel ratio controller for an internal combustion engine, comprising:

a upstream catalyst disposed upstream along an exhaust passage;

a hydrocarbon-adsorbent exhaust purification catalyst that is disposed downstream from said upstream catalyst and has the function of adsorbing hydrocarbons at low temperatures and releasing the adsorbed hydrocarbons as the temperature rises;

upstream air/fuel ratio detection means disposed upstream from said upstream catalyst, for detecting the exhaust air/fuel ratio of exhaust gas flowing into the upstream catalyst;

downstream air/fuel ratio detection means disposed downstream from the hydrocarbon-adsorbent exhaust purification catalyst, for detecting the exhaust air/fuel ratio of exhaust gas flowing out of the hydrocarbon-adsorbent exhaust purification catalyst;

middle air/fuel ratio detection means disposed downstream from said upstream catalyst and upstream from the hydrocarbon-adsorbent exhaust purification catalyst, for detecting the exhaust air/fuel ratio of exhaust gas flowing into the hydrocarbon-adsorbent exhaust purification catalyst;

air/fuel ratio main feedback control means for performing main feedback control such that the exhaust air/fuel ratio detected by the upstream air/fuel ratio detection means is kept at a specific main feedback target air/fuel ratio; and air/fuel ratio sub-feedback control means for performing sub-feedback control such that the exhaust air/fuel ratio detected by the downstream air/fuel ratio detection means is kept at a specific sub-feedback target air/fuel ratio while the adsorbed hydrocarbons are being desorbed from the hydrocarbon-adsorbent exhaust purification catalyst, and for performing sub-feedback control such that the exhaust air/fuel ratio detected by the middle air/fuel ratio detection means is kept at a specific sub-feedback target air/fuel ratio after the adsorbed hydrocarbons have been desorbed from the hydrocarbon-adsorbent exhaust purification catalyst.

2. The air/fuel ratio controller for an internal combustion engine according to claim 1, wherein the sub-feedback target air/fuel ratio of the middle air/fuel ratio detection means in effect after the adsorbed hydrocarbons have been desorbed from the hydrocarbon-adsorbent exhaust purification catalyst is varied with respect to the sub-feedback target air/fuel ratio of the downstream air/fuel ratio detection means in effect while the adsorbed hydrocarbons are being desorbed from the hydrocarbon-adsorbent exhaust purification catalyst.

3. The air/fuel ratio controller for an internal combustion engine according to claim 2, wherein the sub-feedback target air/fuel ratio of the downstream air/fuel ratio detection means in effect while the adsorbed hydrocarbons are being desorbed from the hydrocarbon-adsorbent exhaust purification catalyst is set to be leaner than the sub-feedback target air/fuel ratio of the middle air/fuel ratio detection means in effect after the adsorbed hydrocarbons have been desorbed from the hydrocarbon-adsorbent exhaust purification catalyst.

4. The air/fuel ratio controller for an internal combustion engine according to claim 3, wherein the sub-feedback target air/fuel ratio of the middle air/fuel ratio detection means in effect after the adsorbed hydrocarbons have been desorbed from the hydrocarbon-adsorbent exhaust purification catalyst is set to be substantially stoichiometric.

5. The air/fuel ratio controller for an internal combustion engine according to claim 1, further comprising desorption determining means for deciding whether the adsorbed hydrocarbons are in the process of being desorbed from the hydrocarbon-adsorbent exhaust purification catalyst, or have already been desorbed therefrom.

6. The air/fuel ratio controller for an internal combustion engine according to claim 5, the desorption determining means being a temperature sensor that measures the temperature of the hydrocarbon-adsorbent exhaust purification catalyst.

7. The air/fuel ratio controller for an internal combustion engine according to claim 1, wherein a temperature sensor is attached to the hydrocarbon-adsorbent exhaust purification catalyst, and a decision as to whether the adsorbed hydrocarbons are in the process of being desorbed from the hydrocarbon-adsorbent exhaust purification catalyst is made on the basis of the detection result of said temperature sensor.

8. The air/fuel ratio controller for an internal combustion engine according to claim 1, wherein a temperature sensor is attached to the hydrocarbon-adsorbent exhaust purification catalyst, and a decision as to whether the adsorbed hydrocarbons have already been desorbed from the hydrocarbon-adsorbent exhaust purification catalyst is made on the basis of the detection result of said temperature sensor.

9. An air/fuel ratio controller for an internal combustion engine, comprising a upstream catalyst, and a hydrocarbon-adsorbent exhaust purification catalyst that is disposed downstream from said upstream catalyst and has the function of adsorbing hydrocarbons at low temperatures and releasing the adsorbed hydrocarbons as the temperature rises, wherein an air/fuel ratio main feedback control is performed based on output of an air/fuel ratio sensor upstream from said upstream catalyst while hydrocarbons are being desorbed from the hydrocarbon-adsorbent exhaust purification catalyst, and an air/fuel ratio sub-feedback control, in which a target air/fuel ratio of the air/fuel ratio main feedback control is corrected, is performed such that an output of an air/fuel ratio sensor placed downstream from the hydrocarbon-adsorbent exhaust purification catalyst is kept at the target output, and after the desorption of hydrocarbons from the hydrocarbon-adsorbent exhaust purification catalyst, the air/fuel ratio sub-feedback control, in which the target air/fuel ratio of the air/fuel ratio main feedback control is corrected, is performed such that an output of an air/fuel ratio sensor placed between the upstream catalyst and the hydrocarbon-adsorbent exhaust purification catalyst is kept at the target output.

10. The air/fuel ratio controller for an internal combustion engine according to claim 9, wherein the target output during the desorption of hydrocarbons from the hydrocarbon-adsorbent exhaust purification catalyst is different from that after desorption.

11. The air/fuel ratio controller for an internal combustion engine according to claim 10, wherein the target output during the desorption of hydrocarbons from the hydrocarbon-adsorbent exhaust purification catalyst is set to be leaner than the target output after desorption.

12. The air/fuel ratio controller for an internal combustion engine according to claim 11, wherein the sub-feedback target air/fuel ratio of the air/fuel ratio sensor placed between said upstream catalyst and the hydrocarbon-adsorbent exhaust purification catalyst after the desorption of hydrocarbons is set to be substantially stoichiometric.

13. The air/fuel ratio controller for an internal combustion engine according to claim 9, wherein a temperature sensor is attached to the hydrocarbon-adsorbent exhaust purification catalyst, and a decision as to whether the adsorbed hydrocarbons are in the process of being desorbed from the hydrocarbon-adsorbent exhaust purification catalyst is made on the basis of the detection result of said temperature sensor.

14. The air/fuel ratio controller for an internal combustion engine according to claim 9, wherein a temperature sensor is attached to the hydrocarbon-adsorbent exhaust purification catalyst, and a decision as to whether the adsorbed hydrocarbons have already been desorbed from the hydrocarbon-adsorbent exhaust purification catalyst is made on the basis of the detection result of said temperature sensor.

* * * * *